United States Patent [19]

Everett et al.

[11] 4,422,748

[45] Dec. 27, 1983

[54] APPARATUS FOR TRANSPORTING AND PROCESSING PHOTOGRAPHIC MATERIALS OR THE LIKE

[75] Inventors: Montague Everett, Greenwich, Conn.; Joseph Charipar, Thousand Oaks, Calif.

[73] Assignee: U.S. Philips Corporation, New York, N.Y.

[21] Appl. No.: 273,548

[22] Filed: Jun. 15, 1981

[51] Int. Cl.[3] ..... G03D 3/08

[52] U.S. Cl. ..... 354/316; 354/322; 354/329; 354/344; 198/472; 198/725; 198/735; 134/75

[58] Field of Search ..... 354/312, 315, 316, 319, 354/320, 321, 322, 329, 330, 340, 344, 345, 346; 206/455, 456; 198/342, 472, 688, 725, 735; 134/74, 75, 83, 124, 125

[56] References Cited

U.S. PATENT DOCUMENTS

| | | | |
|---|---|---|---|
| 3,672,289 | 6/1972 | Kelso | 354/322 |
| 3,882,525 | 5/1975 | Zwettler | 354/316 |
| 3,882,527 | 5/1975 | Sawada et al. | 354/322 |
| 4,032,943 | 6/1977 | Zwettler | 354/322 |
| 4,112,452 | 9/1978 | Patton | 354/322 |
| 4,125,852 | 11/1978 | Brooks | 354/322 |

*Primary Examiner*—A. A. Mathews
*Attorney, Agent, or Firm*—Jack E. Haken

[57] ABSTRACT

Apparatus for developing photographic film includes a substantially cylindrical, open sided carrier which retains spaced-apart parallel sheets of photographic film within the cylinder. A plurality of horizontal open-topped chemical troughs are disposed side-by-side with a second lip of each trough in the series being disposed adjacent a first lip of the succeeding trough in the series. The film carrier is deposited adjacent the first lip of the first trough. A transport mechanism in each trough rolls the carrier along the inner surface of the trough so that it is ejected over the second lip and drops into the next succeeding trough in the series. The carrier is finally ejected over the second lip of the last trough into a drying chamber where it is subjected to a flow of heated air. The processor is particularly suitable for processing sheets of intraoral dental film.

40 Claims, 10 Drawing Figures

Fig. 3
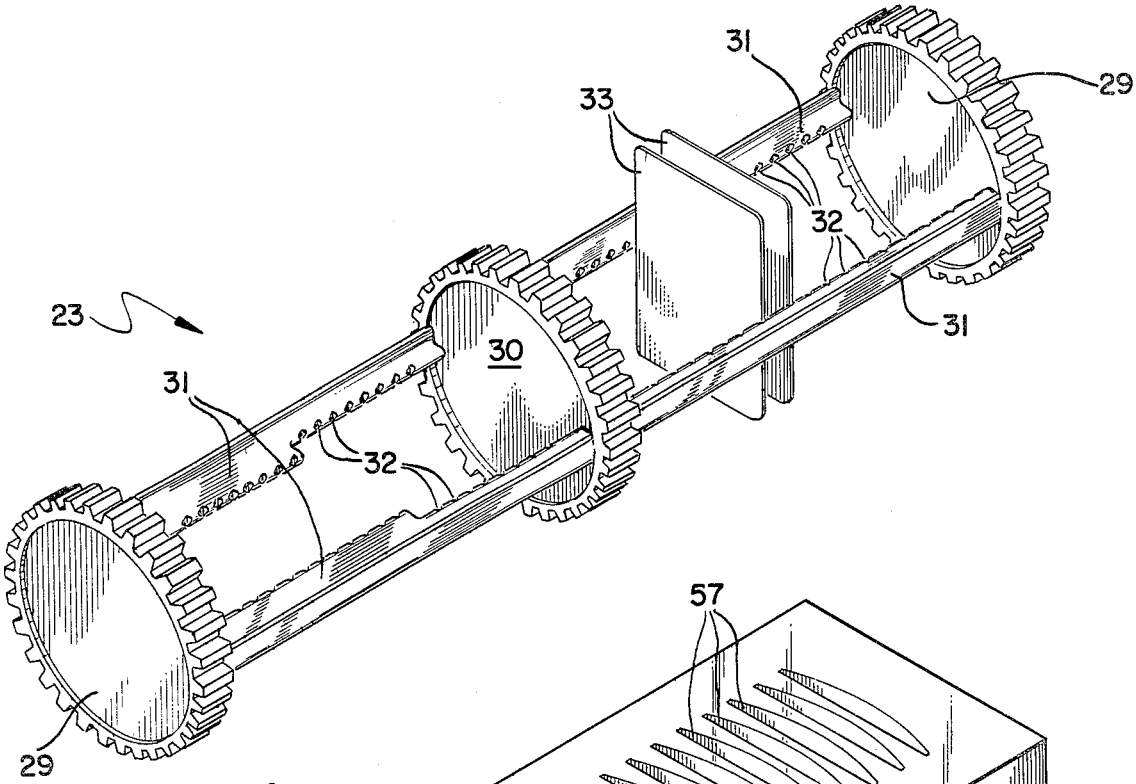
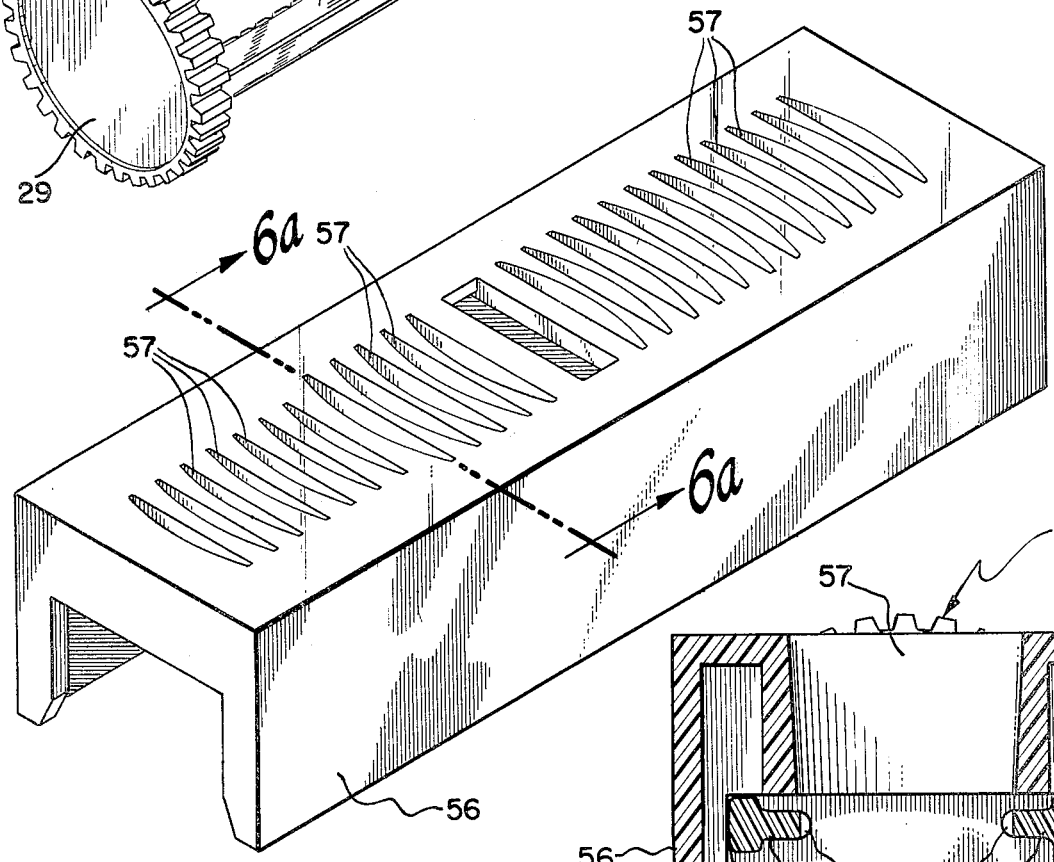
Fig. 6
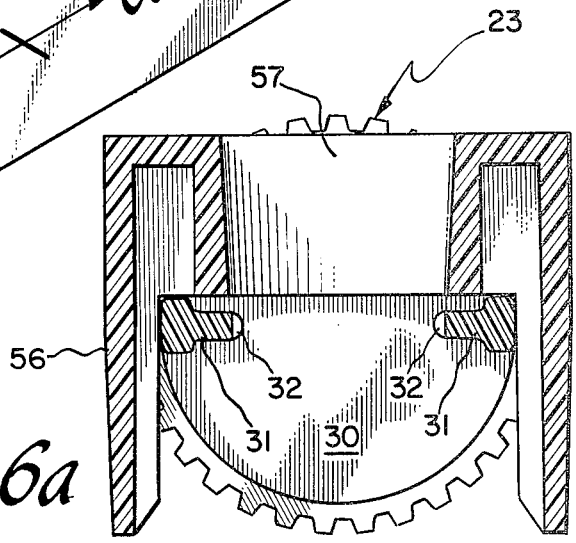
Fig. 6a

Fig. 4
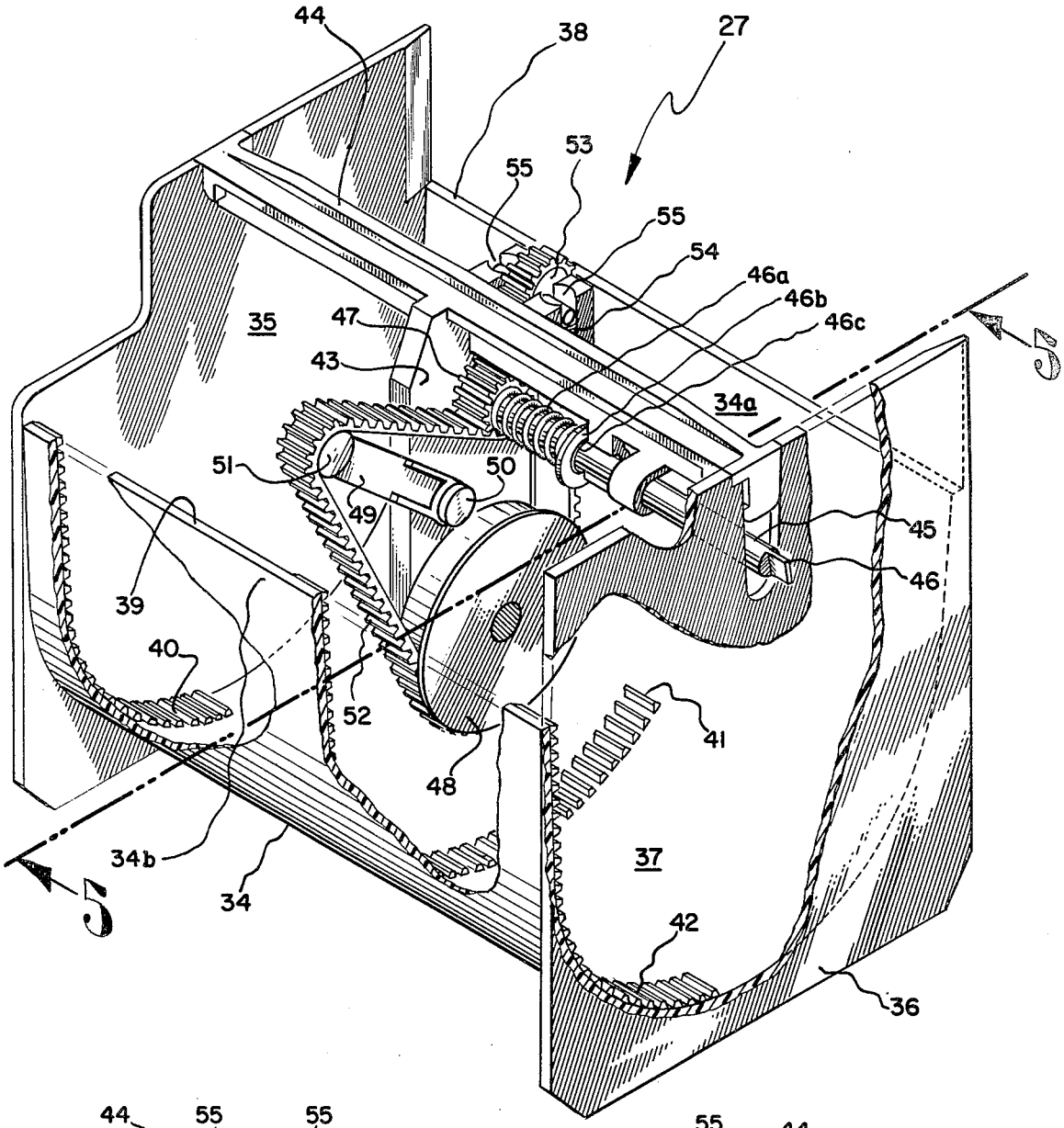
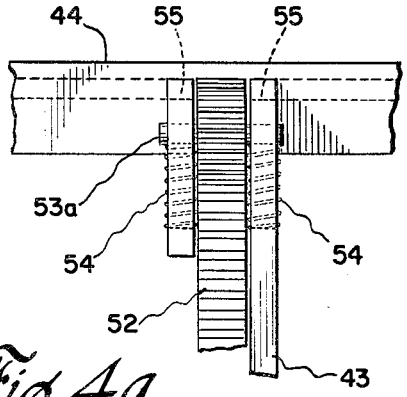
Fig. 4a
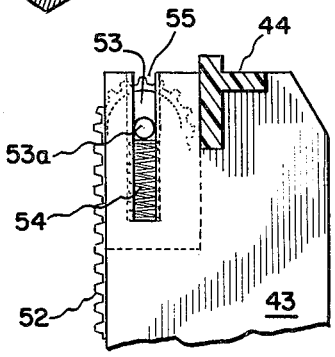
Fig. 4b 23
51
27
44
53
53a
54
55
52a
45
47
46a
A
B
49
50
43
52
39
38
34b
52b
34a
35
48
(40,41,42)
37
23
41
34

APPARATUS FOR TRANSPORTING AND PROCESSING PHOTOGRAPHIC MATERIALS OR THE LIKE

The application relates to apparatus for developing photographic material. The apparatus is particularly suitable for developing sheets of intraoral dental X-ray film.

BACKGROUND OF THE INVENTION

Apparatus which develops photographic film by transporting exposed film through successive tanks of chemical solutions is well known in the prior art. If the film to be developed is in roll form the transport mechanism usually comprises a series of rollers which direct a continuous strip of film in and out of the various tanks. If the film comprises separate flat sheets, prior art transport mechanisms usually propel the film through pairs of resilient pinch rollers disposed in the chemical tanks and along the transport path. Pinch roller assemblies are inherently difficult to clean and it was often necessary to disassemble the associated drive mechanism to allow effective removal of chemical residue.

SUMMARY OF THE INVENTION

It is an object of this invention to provide an efficient automated processor for photographic film and other materials which does not utilize pinch rollers and is therefore easily disassembled for cleaning. The present invention is particularly suited for developing dental X-ray film in a clinical environment.

In accordance with the present invention a plurality of sheets of photographic film are retained in an open-sided, cylindrical film carrier. The film carrier supports the film sheets in substantially parallel, spaced apart planes which are perpendicular to the cylinder axis. A loading fixture facilitates placement of the film within the carrier.

The processor mechanism successively transports the film carrier through parallel open-topped troughs filled with developer, fixer solution and water and finally deposits the carrier into a stream of heated air in a drying chamber. Each of the chemical troughs includes a transport mechanism which engages the film carrier near the bottom of the trough and ejects the carrier from the trough by rolling it up the inner surface of the trough wall and over a lip of the trough. The carrier then drops into a succeeding trough or into the drying chamber. The rolling movement of the carrier rotates each film sheet, in the plane of the sheet, as it is transported through the chemical solution and thus provides agitation which assures uniform development. A heater is provided to maintain the developer and fixer solutions at approximately 83° F. (28° C.).

In a preferred embodiment of the invention, sprocket teeth are provided on the periphery of the film carrier. The carrier is rotated by a moving rubber belt having outwardly directed teeth which engage the periphery of the carrier. A swing arm assembly holds the carrier between the belt and the inner surface of the trough wall and acts to eject the carrier over the lip of the trough.

In a further refinement of the invention racks on the inner surface of the trough wall engage teeth on the periphery of the film carrier and constrain the carrier to roll along the trough surface, without slipping, as it is raised by the transport mechanism. A plurality of parallel racks may be utilized to assure that the carrier remains parallel to the trough and does not become cocked as it climbs the trough wall.

BRIEF DESCRIPTION OF THE DRAWINGS

The invention may be better understood by reference to the accompanying drawings in which:

FIG. 3 is a loaded film carrier;

FIG. 4 is a cut-away perspective view of a single chemical trough and transport mechanism;

FIG. 4*a* and 4*b* show details of the belt tensioner in FIG. 4;

FIG. 6 is a view of a fixture for loading film into the film carrier;

FIG. 6*a* is a sectional view showing the film carrier engaged with the loading fixture.

DESCRIPTION OF A PREFERRED EMBODIMENT

Figure 1:
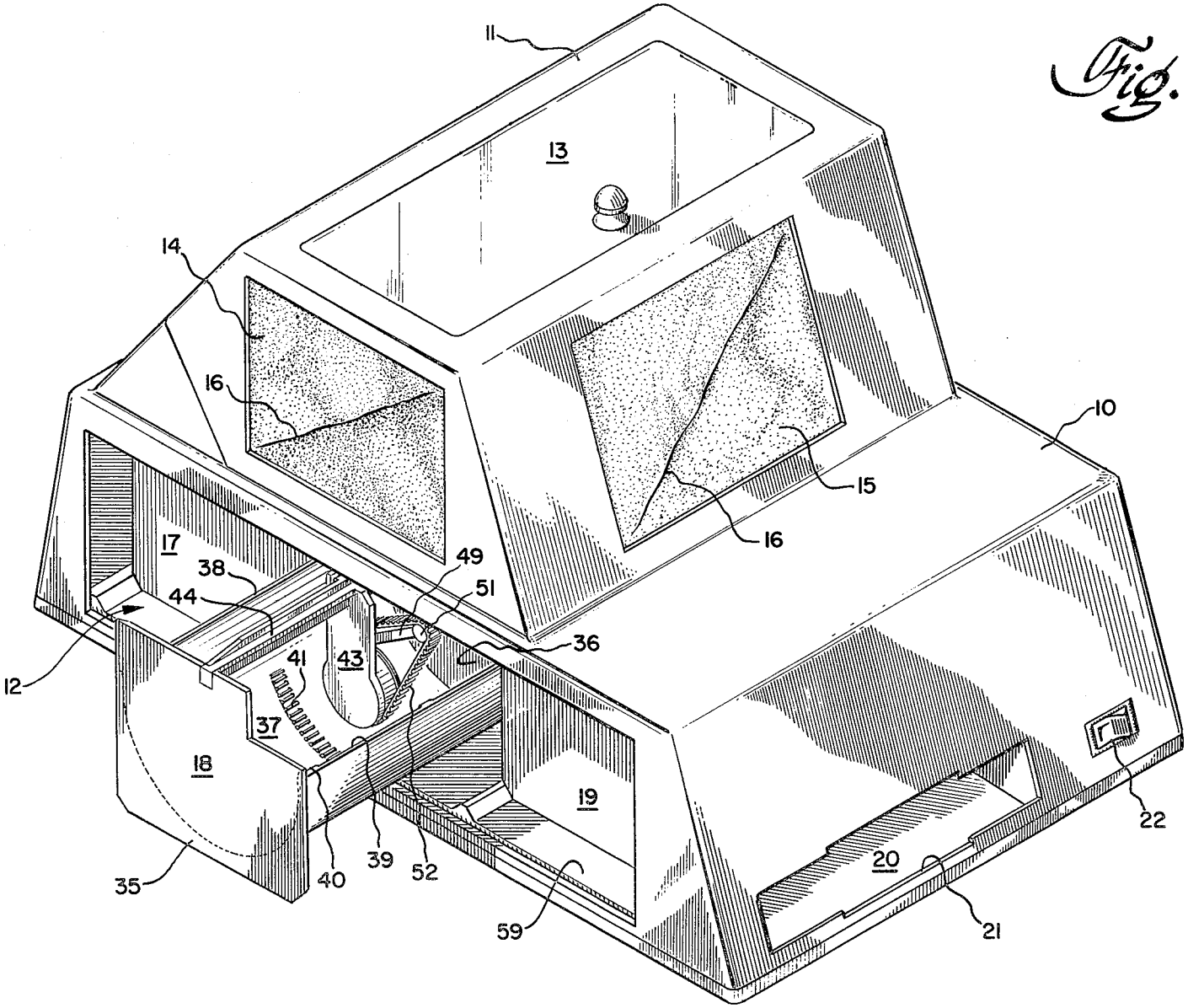
FIG. 1 is a film processor of the present invention.
Figure 2:
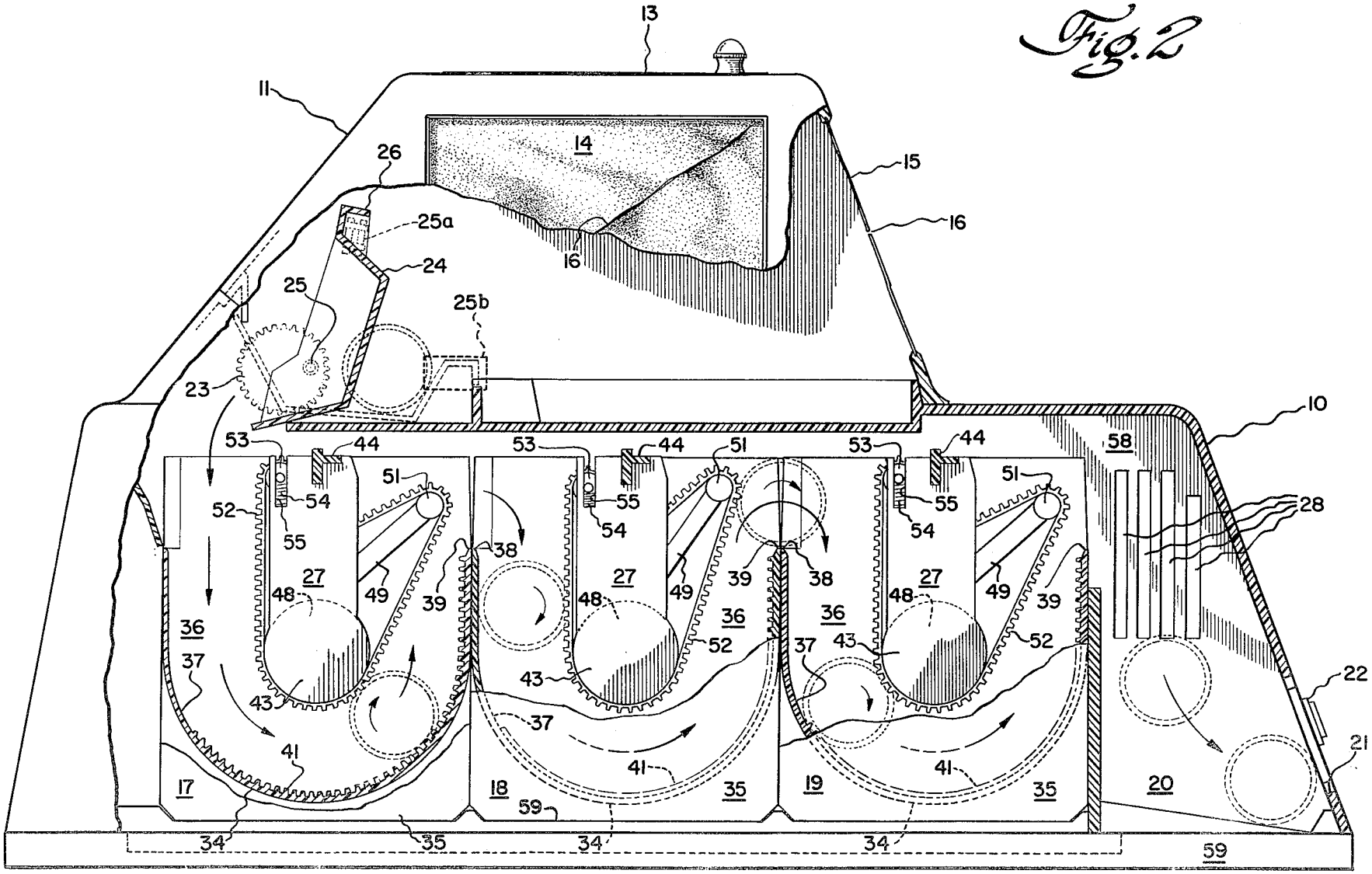
FIG. 2 is a cut-away front view of the film processor of FIG. 1.

FIGS. 1 and 2 are a film processing in accordance with the present invention. A film transport and chemical processing mechanism is mounted on a base 59 and contained within a light-tight lower housing 10. An upper housing 11 is mounted on top of the lower housing and provides a safe-lighted area for loading exposed film into carriers. The upper housing is provided with a removable door 13 which provides access for inserting exposed film packages into the upper housing. The door 13 may be constructed as a transparent, safe-light window (which only passes light outside of the spectral sensitivity range of the film to be processed). When processing dental X-ray film the door 13 typically comprises a transparent amber plastic. A pair of openings in the sides of the upper housing are covered with rubber panels 14 and 15. The panels are provided with slits 16. Typically, a technician using the processor inserts his hands through the slits 16 to unwrap a light protective covering from the film sheets while viewing the operation through the window 13. The rubber panels close around technicans' wrist to provide a light-tight confinement for unwrapping and loading the film.

The lower housing 10 is provided with a removable panel (not shown) which covers an opening 12. The opening allows access to the film transport and processing mechanism enclosed therein. The processing mechanism comprises three parallel open-topped chemical troughs 17, 18 and 19 each of which supports a film carrier transport mechanism 27. The chemical troughs are disposed side-by-side and are slidable on the base 59 for removal through the opening 12.

In typical operation (FIG. 2) a film carrier 23 (more particularly described below) is dropped from the upper housing into the input (left) side of the first trough 17 which contains a developer solution. The carrier transport mechanism 27 in the first trough lifts the film carrier up the output (right) side of the trough and over the output (right) lip 39 to eject it into the input side of the second trough 18 which contains a fixer solution. The carrier transport mechanism in the second trough lifts the carrier over its output lip into the third trough 19 which contains a wash solution. The carrier transport mechanism in the third trough lifts the carrier over its output lip and ejects it into a drying chamber 20. The film carrier is removed from the drying chamber 20 through an access port 21.

The transport mechanism and an air heater are activated (in a manner more particularly described below) when the film carrier is dropped into the first trough 17. Master power for the transport mechanism, and for chemical heaters, is controlled with a master switch 22 on the outside of the lower housing.

FIG. 2 illustrates the interior of the upper housing and the mechanism for dropping the film carrier into the first trough 17. The film carrier 23 is loaded with sheets of exposed film in the upper housing using a loading fixture and is placed in a dumper tray 24. The dumper is then activated by raising handle 26 to pivot the tray around an axis 25 and drop the film carrier into the input side of the first trough 17. The tray 24 is balanced to return to a horizontal position under its own weight and thus close the opening between the lower housing and upper housing. In this position it tends to prevent the entrance of chemical vapors from the lower housing into the interior of the upper housing.

A magnet 25*a* is disposed on the side of the dumper tray. The magnet activates a proximity switch 25*b* mounted in the lower housing when the dumper tray is in the closed (horizontal) position. Raising and lowering the tray thus cycles the switch 25*b* and, through a timing circuit, causes a motor and air heater in the processor to operate for a predetermined time.

FIG. 3 is a film carrier 23 which supports and transports the film sheets through the chemical troughs. The carrier is substantially cylindrical in outline and comprises a pair of flat oppositely disposed film support frames 31 disposed between a pair of parallel, externally toothed end wheels 29. An externally toothed center wheel 30 is likewise supported by the frames 31. The interior edges of the frames 31 are provided with sets of oppositely disposed grooves 32. Sheets of film 33 are slightly bowed and inserted between the grooves where they are retained by the force provided by the resiliency of the film. The film carrier is sized so that standard film sheets are retained entirely within the cylinder outline defined by the periphery of the end wheels. The frame serves to maintain the sheets in a substantially parallel, spaced-apart configuration parallel to the plane of the end wheels.

The three chemical troughs 17, 18 and 19 are identical. FIGS. 4, 4*a*, 4*b*, and 5 show a typical trough. The trough is formed by an open-topped, curved bottom sheet 34 having a horizontal inlet lip 38 and a parallel outlet lip 39. The front and the back ends of the trough are closed, respectively, by parallel end plates 35 and 36 which are disposed perpendicular to the bottom sheet 34 and the lips 38 and 39. In a preferred embodiment the bottom portion of the inner surface of the trough is substantially semicylindrical with flat, substantially vertical input and output walls 34*a* and 34*b*. The inner surface 37 of the trough 34 is provided with three racks 40, 41 and 42 which run parallel to the end plates and are spaced to engage the teeth on wheels 29 and 30 of the film carrier. The racks assure that the film carrier rolls, without slipping, along the inner surface of the trough and prevent cocking of the carrier (and thus maintain it parallel to the lips) as it is transported through the trough. The three racks extend along the bottom of the tank but are not present on the input wall 34*a*. The teeth at the input end of the racks may be modified to facilitate engagement with the film carrier.

The transport mechanism 27 is removable for cleaning. It is supported on a horizontal beam 44, which is retained in notches in the end plates 35 and 36, and is disposed on a vertical fin 43 which hangs from the beam 44, parallel to the end plates, in the center of the tank.

Figure 7:
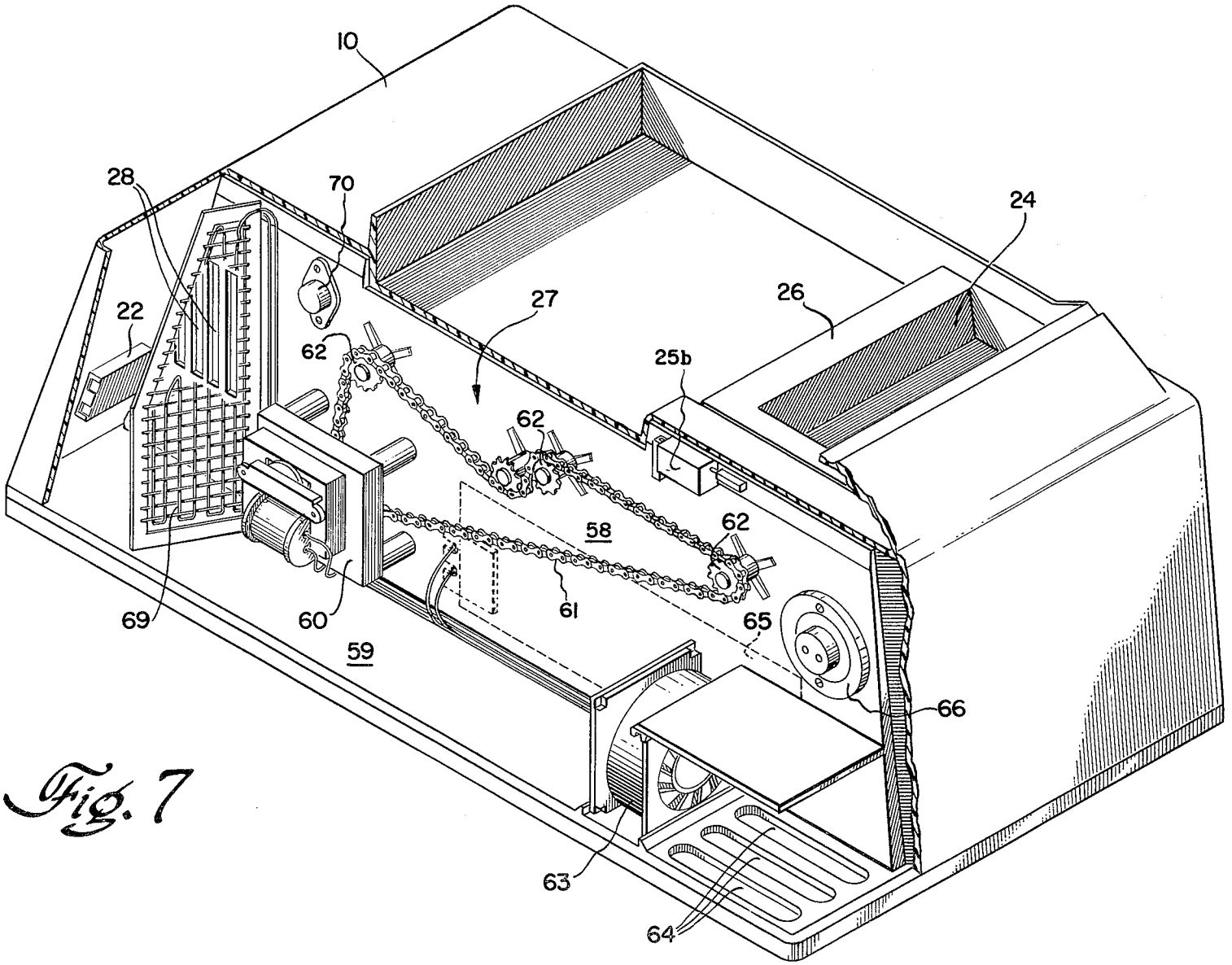
FIG. 7 is a cut-away back view of the film processor.

Power is transmitted to the transport mechanism along a shaft 45 which extends from the fin 43 through the back plate 36. The end of the shaft most distant from the fin is provided with a spline 46 which is adapted for sliding engagement with a matching socket on sprocket gears 62 (FIG. 7). The shaft 45 is supported by a bearing in the fin and slidably engages a drive sprocket 47. A spring 46*a* bears on drive sprocket 47 and, through washer 46*b* and clip 46*c* on the shaft 46 to facilitate engagement of the spline and socket.

The drive sprocket 47 engages a toothed rubber belt 52. The belt is in the form of a closed loop with toothed surface outermost. The belt loop passes over a tensioner idler 53, a sheave 48 and a roller 51. The sheave 48 is supported in a bearing at the lower end of the fin 43. The distance between the belt 52 at the surface of the sheave 48 and the bottom portion of the trough is approximately equal to the diameter of the film carrier.

The tensioner idler 53 is supported by and rotates around a shaft 53*a* which rides in vertical slots 55 at the top of the fin (FIGS. 4*a* and 4*b* ). The tensioner idler shaft is forced upward by compression springs 54 which are contained between the shaft and the bottom end of the slots 55.

The roller 51 is supported on the end of an arm 49 which extends from a pivot 50 on the surface of the fin below the level of the drive sprocket 47 toward a point above the output lip 39. The angle A between the belt segment 52*a* connecting the roller 51 with the drive sprocket 47 and the centerline of the arm is smaller than the angle B between the belt segment 52*b* connecting the roller 51 with the sheave 48 and the centerline of the arm. Tension in the belt 52, which is produced by the springs 54, thus tends to pull the roller 51 toward the output lip 39.

Figure 5:
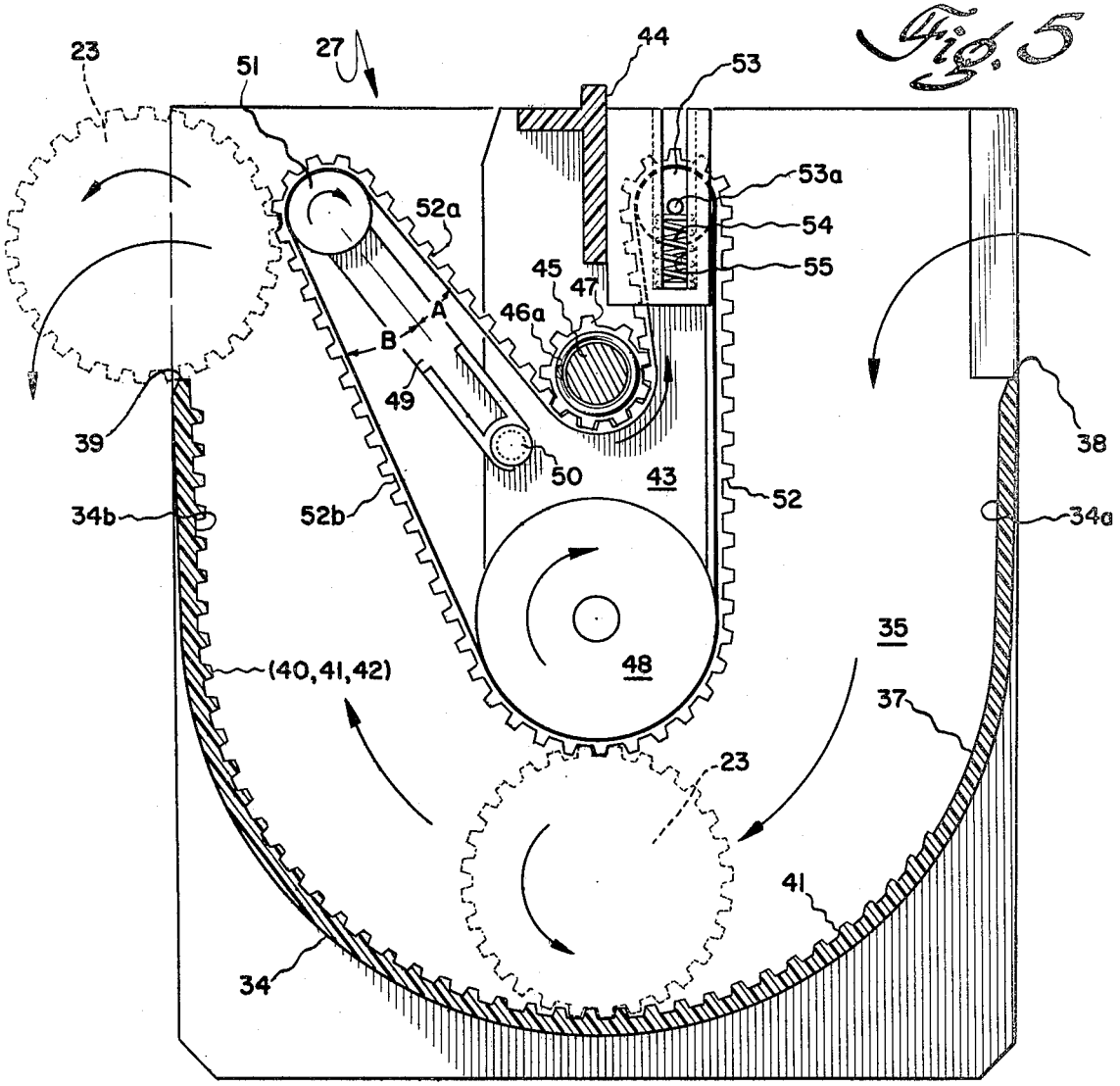
FIG. 5 is a sectional view of a chemical trough and transport mechanism.

The operation of the drive mechanism is illustrated in FIG. 5. The film carrier 23 is initially dropped over the input lip 38 and falls into the trough. At the bottom of the trough, the teeth on the film carrier engage racks 40, 41 and 42 on the inner surface of the trough. The teeth on the central wheel of the film carrier 30 also engage the toothed belt 52 as it passes over sheave 48. The belt 52 is driven by sprocket 47 and in turn rotates the film carrier; driving it along the racks 40, 41 and 42, up the output wall 34*b* toward lip 39. As the carrier moves up the wall it presses the belt 52 and roller 51 toward the fin; rotating the arm 49 upward around pivot 50 and drawing the tensioner idler 53 down against the force of the springs 54. When the center of the carrier climbs above the output lip 39, the force of the springs 54 (which is transmitted to the arm 49 and roller 51 via tension in the belt 52) ejects the carrier over the lip. In a preferred embodiment the arm 49 maintains the roller 51 at a height which is at least equal to the radius of the carrier above the level of the output lip.

FIGS. 6 and 6*a* are a fixture 56 which aids in the placement and insertion of film sheets into the carrier. The fixture is normally used within the upper housing 11 (FIG. 2) and is adapted for engagement with the wheels and frames 31 of the film carrier. D-slots 57 on the upper surface of the carrier are thus aligned with the notches 32 in carrier frames 31 when the carrier is inserted into the fixture. The technician slightly bows the film sheets to insert them in the D-slots which, in turn, assure alignment of the film with the notches in the film carrier.

FIG. 7 is a back cut-away view of the film processor. A divider wall 58 extends the length of the processor. It separates the chemical troughs from a back chamber which encloses components of the processor drive and control mechanism. Three sprockets 62 are supported on bearings in the divider wall 58 opposite the chemical troughs 17, 18 and 19. The hubs of the sprockets 62 contain sockets (not shown) for engagement with the matching splines 46 on the shafts 45 extending from each of the troughs. The sprockets 62 are engaged and rotated by a roller chain 61 which is driven by an electric motor 60. The divider wall 58 also supports a heater pad 65 adjacent the chemical troughs and a sensor 66 which controls the heater 65 by measuring the temperature of chemicals in one or more of the troughs. Proximity switch **25*b*** is likewise mounted on the divider wall.

Ambient air is drawn into the back chamber of the processor through intake louvers 64 by a fan 63. The air passes over an electric heater mesh 69 and through outlet louvers 28 into the drying chamber 20. Operation of the heater mesh 69 is controlled by a safety thermostatic element 70 which shuts down the heater mesh if air flow is shut off.

The proximity switch **25*b* is activated when the dumper 24 is opened, to deposit a film carrier into the first trough, and then closed. A time delay circuit then continues to enable motor, heater mesh, and fan operation for a period of time sufficient to transport the carrier through the three troughs and for drying. Typically, the carrier is transported through all three troughs at a constant speed and the time delay circuit is operated for approximately 6.5 minutes. In alternate embodiments the motor may be provided with a speed control. Likewise, the diameter of the drive sprockets 62 and/or 47** may be varied, from tank to tank, to decrease the time which the carrier spends in the successive troughs.

What is claimed:

1. Apparatus for ejecting a small-diameter cylindrical object from a larger-diameter, substantially semicylindrical, horizontal open-topped trough having a horizontal lip, the axis of the object being approximately parallel to the lip, comprising:

toothed belt means for pressing the object against an inner surface of the trough and rotating the object about its axis and means which constrain the object to roll, without slipping along the inner surface of the trough.

2. The apparatus of claim 1 wherein the means for pressing further function to eject the object over the lip.

3. The apparatus of claim 1 wherein the means which constrain the object comprise one or more racks disposed on the inner surface of the trough and a like number of sets of teeth extending circumferentially around the periphery of the object for mating with the racks.

4. The apparatus of claim 1 further comprising means which constrain the object so that its axis is substantially parallel to the lip of the trough.

5. The apparatus of claim 4 wherein the means which constrain the object so that its axis is substantially parallel to the lip of the trough, comprise at least two parallel racks disposed on the inner surface of the trough, perpendicular to the lip, and a like number of sets of teeth extending circumferentially around the periphery of the object for mating with the racks.

6. The apparatus of any of claims 1 through 5 wherein the cylindrical object is a film carrier which includes means for retaining a plurality of parallel sheets of photographic material within the cylinder and perpendicular to its axis.

7. Apparatus for transporting a substantially cylindrical film carrier through and out of a horizontal open-topped trough, said trough having an inner surface which includes a vertical portion which is topped by a horizontal lip, comprising means which engage the periphery of the carrier with an inner surface of the trough to constrain the carrier to roll, without slipping, along the inner surface;

means which press the carrier against the inner surface of the trough and urge the carrier over the lip; and means which engage the periphery of the carrier at a point which is substantially diametrically opposite its point of engagement with the surface of the trough and which rotate the carrier about its axis, whereby the carrier is transported along the inner surface of the trough.

8. The apparatus of claim 7 wherein the means which engage the carrier comprise a toothed belt.

9. The apparatus of claim 8 wherein the means which press the carrier comprise means for tensioning the belt.

10. A carrier for a photographic processor comprising:

a plurality of parallel wheels of equal diameter disposed along a common axis and support and retaining means disposed between the wheels for supporting and retaining the outside edges of a plurality of substantially parallel, spaced-apart sheets of photographic material to maintain said sheets perpendicular to the axis and within the outline of a cylinder which is defined by the outer peripheries of the wheels.

11. The carrier of claim 10 wherein the outer periphery of one or more of the wheels are toothed for engagement with racks and/or with a toothed belt.

12. The carrier of claim 10 or 11 wherein the wheels comprise a pair of end wheels which are disposed at opposite ends of the carrier and a central wheel which is disposed midway therebetween.

13. The carrier of claim 12 wherein the end wheels are toothed for engagement with racks and the central wheel is toothed for engagement with a toothed belt.

14. The carrier of claim 12 wherein the support and retaining means comprise a pair of parallel flat frames, which are symetrically disposed with respect to the axis and which define a plurality of oppositely disposed grooves for retaining the edges of the sheets.

15. Photographic processing apparatus comprising:

a horizontal open-topped cylindrical trough which comprise an inner surface which includes a lower portion having an upwardly concave, substantially semicircular cross-section, a first horizontal lip, and a second horizonal lip;

a cylindrical carrier comprising a plurality of parallel wheels of equal diameter disposed along an axis and support and retaining means disposed between the wheels for supporting and retaining a plurality of substantially parallel, spaced-apart sheets of photographic material perpendicular to the axis and within the outline of a cylinder which is defined by the perpheries of the wheels; and means for pressing the carrier against the inner surface and for rotating the carrier around its axis to roll the carrier along the inner surface and over the second lip.

16. The apparatus of claim 15 further comprising means which constrain the carrier to roll, without slipping, along the inner surface.

17. The apparatus of claim 15 further comprising means which maintain the carrier axis in a horizontal orientation.

18. The apparatus of claim 16 or 17 wherein the means which constrain comprise teeth on the outer periphery of one or more of the wheels and one or more racks disposed on the inner surface of the trough and adapted for engagement with the teeth.

19. The apparatus of claim 18 wherein the means for pressing the carrier against the inner surface comprises a belt and means which maintain tension in the belt.

20. The apparatus of claim 19 wherein the belt comprises teeth and the carrier comprises a central toothed wheel adapted for engagement with the teeth of the belt.

21. Means for transporting a cylindrical carrier through a horizontal open-topped trough which comprises an inner surface including an upwardly concave lower portion having a substantially semicircular cross section, a first horizontal lip, and a second, opposite, horizontal lip; comprising:

a sheave suspended within the trough for rotation about a horizontal sheave axis which is co-axial with the axis of the lower portion of the trough;

an arm, having a first end which is pivotably affixed within the trough to allow rotation of the arm about a horizontal pivot axis which is diposed below the level of the second lip, and a second end which extends from the pivot axis toward a point above the second lip;

a roller diposed at the second end of the arm for rotation in the plane of the sheave;

a belt, having outwardly directed teeth, which passes over the sheave and the roller, the belt comprising a lower span which extends from the sheave to the roller and an upper span which extends from the roller and away from the second lip, the angle between the lower span and the arm being, at all times, greater than the angle between the upper span and the arm;

means for maintaining tension in the belt, whereby the roller is urged toward the second lip; and means for moving the belt over the sheave and roller so that the lower span translates upwardly.

22. The apparatus of claim 21 wherein the axis of the roller is not less than the radius of the film carrier above the height of the second lip.

23. The apparatus of claim 21 or 22 wherein the distance between the periphery of the sheave and the lower section of the trough is approximately equal to the diameter of the carrier.

24. The apparatus of claim 23 where the means for moving the belt is a sprocket disposed directly above the axis of the sheave for rotation about a sprocket axis which is above the level of the pivot axis.

25. The apparatus of claim 21 or 22 wherein the belt forms a closed loop.

26. The apparatus of claim 25 wherein the trough further comprises a front end plate and a back end plate, which plates extend perpendicular to the axis of the lower portion, and further comprising:

a beam, which spans the top of the trough from the front end plate to the back end plate and a vertical fin, which extends from the beam into the trough and supports the sheave, the arm, and the sprocket.

27. An automatic photographic processor comprising:

a plurality of open-topped horizontal troughs, each trough comprising an inner surface including a lower portion which has an upwardly concave, substantially semicircular cross section, a first horizontal top lip and a second, opposite horizontal top lip;

said troughs being disposed side-by-side in a series with the first lip of each succeeding trough disposed adjacent the second lip of the preceeding trough in the series;

means for depositing an open-sided cylindrical carrier which retains and supports a plurality of spaced-apart, substantially parallel sheets of photographic material within the cylinder and perpendicular to the cylinder axis, into a first trough in the series, adjacent its first lip with the axis of the carrier substantially horizontal; and means within each trough which rotate the carrier so that it rolls along the inner surface of that trough, towards the second lip thereof and which eject the carrier over the second lip of that trough, with the axis of the carrier horizontal, whereby the carrier falls into each succeeding tray in the series adjacent the first lip thereof and is eventually ejected over the second lip of a last trough in the series.

28. The apparatus of claim 27 further comprising a drying chamber disposed adjacent the second lip of the last trough in the series and means for forcing air through the drying compartment.

29. The apparatus of claim 28 further comprising means for heating the air before it is forced through the drying chamber.

30. The apparatus of claim 27 further comprising a light-tight upper housing disposed above the chemical troughs and wherein the means for depositing the carrier in the first trough comprises a dumper tray, which can be loaded with a carrier from the upper housing and which pivots about a horizontal axis to deposit the carrier into the first trough.

31. The apparatus of claim 30 further comprising means for loading sheets of film into the carrier which means are contained within the upper housing.

32. The apparatus of claim 31 further comprising switch means for activating the means which rotate the carrier when the dumper tray is pivoted to deposit the carrier in the first trough and which continue, thereafter, to activate the means which rotate the carrier at least until the carrier is ejected over the second lip of the last trough.

33. The apparatus of claim 29 further comprising a light-tight lower housing which encloses the chemical troughs, wherein the means which rotate the carrier comprise an electric motor disposed within the lower housing, a plurality of socketed sprockets, one sprocket being associated with each trough, affixed within the lower housing, and a plurality of splinedshafts, one shaft being associated with each chemical trough, and which are adapted for engagement with sockets in the respective sprockets.

34. The apparatus of claim 27, 28 or 29 further comprising means for heating liquid in at least one of the troughs.

35. The apparatus of claim 27, 28, 29, 30, 31, 32, or 33, further comprising:

a cylindrical carrier comprising a plurality of parallel wheels of equal diameter disposed along an axis and support and retaining means disposed between the wheels for supporting and retaining a plurality of substantially parallel, spaced-apart sheets of photographic material perpendicular to the axis and within the outline of a cylinder which is defined by the peripheries of the wheels; and wherein the means within each trough comprises means for pressing the carrier against the inner surface and for rotating the carrier around its axis to roll the carrier along the inner surface and over the second lip.

36. The apparatus of claim 35 further comprising means which constrain the carrier to roll, without slipping, along the inner surface.

37. The apparatus of claim 35 further comprising means which maintain the carrier axis in a horizontal orientation.

38. The apparatus of claim 27, 28, 29, 30, 31, or 32 wherein the means within each trough comprise:

a sheave suspended within the trough for rotation about a horizontal sheave axis which is co-axial with the axis of the lower portion of the trough;

an arm, having a first end which is pivotably affixed within the trough to allow rotation of the arm about a horizontal pivot axis which is disposed below the level of the second lip, and a second end which extends from the pivot axis towards a point above the second lip;

a roller disposed at the second end of the arm for rotation in the plane of the sheave;

a belt, having outwardly directed teeth, which passes over the sheave and the roller, the belt comprising a lower span which extends from the sheave to the roller and an upper span which extends from the roller and away from the second lip, the angle between the lower span and the arm being, at all times, greater than the angle between the upper span and the arm;

means for maintaining tension in the belt, whereby the roller is urged toward the second lip; and means for moving the belt over the sheave and roller so that the lower span translates upwardly.

39. The apparatus of claim 38, wherein the axis of the roller is not less than the radius of the film carrier above the height of the second lip.

40. The apparatus of claim 38, wherein the distance between the periphery of the sheave and the lower section of the trough is approximately equal to the diameter of the carrier.

* * * * *